United States Patent [19]

Mituyasu et al.

[11] 4,091,781

[45] May 30, 1978

[54] AIR-FUEL RATIO CONTROL SYSTEM IN AN INTERNAL COMBUSTION ENGINE

[75] Inventors: Masaki Mituyasu; Takatoshi Masui, both of Susono, Japan

[73] Assignee: Toyota Jidosha Kogyo Kabushiki Kaisha, Toyota, Japan

[21] Appl. No.: 728,903

[22] Filed: Oct. 4, 1976

[30] Foreign Application Priority Data

June 10, 1976 Japan ..... 51-67049

[51] Int. Cl.[2] ..... F02M 7/00; F02M 7/02

[52] U.S. Cl. ..... 123/119 EC; 123/59 PC; 60/276; 261/23 A;121 B;DIG. 74

[58] Field of Search ..... 123/127, 119 EC, 32 EE, 123/59PC, DIG. 8, 124 B; 261/121 B, 23 A, DIG. 74; 60/276, 285

[56] References Cited

U.S. PATENT DOCUMENTS

| | | | |
|---|---|---|---|
| 3,742,922 | 7/1973 | Hisatomi et al. | 261/23 A |
| 3,827,237 | 8/1974 | Linder et al. | 123/32 EE |
| 3,963,009 | 6/1976 | Mennesson | 123/119 EC |
| 3,982,393 | 9/1976 | Masaki et al. | 123/59 PC |
| 4,030,292 | 6/1977 | Masaki et al. | 123/119 EC |

FOREIGN PATENT DOCUMENTS

| | | | |
|---|---|---|---|
| 117,831 | 11/1974 | Japan | 123/119 EC |

*Primary Examiner*—Charles J. Myhre
*Assistant Examiner*—Andrew M. Dolinar
*Attorney, Agent, or Firm*—Stevens, Davis, Miller & Mosher

[57] ABSTRACT

An air-fuel ratio control system in a twin carburetor type of an internal combustion engine comprising two SU carburetors each provided with an air-bleed passage opening into a main nozzle of said carburetor, a quantity of the bled air being regulated by an electromagnetic valve means which operates in response to an output signal emanating from a common oxygen sensor installed in the exhaust manifold, a phase difference being produced between input signals supplied to the two electromagnetic valve means, by a phase difference control unit.

4 Claims, 6 Drawing Figures

AIR-FUEL RATIO CONTROL SYSTEM IN AN INTERNAL COMBUSTION ENGINE

This invention relates to an internal combustion engine provided with multi-cylinders, comprising so-called SU carburetors with variable venturis and, in particular, said invention relates to an improved air-fuel ratio control system thereof.

There is known a so-called "SU carburetor" with a variable venturi in which the cross-sectional area of the venturi is varied in response to the flow rate of the suction air for keeping the speed of the air current therethrough constant.

In an arrangement of a twin-carburetor type of a four-cylinder internal combustion engine, according to the prior art, the arrangement includes two cylinders provided for each carburetor, and the two SU carburetors are identically and simultaneously operated, to regulate the engine air-fuel ratio (A/F). However, in this control system of the prior art, since the two SU carburetors are identically and simultaneously operated as mentioned above, the fluctuation of the engine A/F is presented as the resultant of the fluctuation attendant to each of the two carburetors, thus, resulting in a large fluctuation.

The main object of the present invention is to eliminate the above drawback.

In the invention of U.S. Pat. No. 3,963,009 a feedback air-fuel ratio control system in an internal combustion engine comprising an SU carburetor in which an air-bleed passage opens into the main nozzle of the carburetor is provided, and an electromagnetic valve means is arranged in the air-bleed passage, said valve means operating in response to a signal emanating from an oxygen sensor called a λ sensor, installed in the exhaust manifold for regulating the flow rate of the bled air.

The present invention provides an air-fuel control system in a twin-carburetor type of an internal combustion engine comprising two such improved SU carburetors a single common oxygen sensor installed in the exhaust manifold, a control unit into which a detecting signal from the oxygen sensor is fed and which unit supplies control signals to each of the electromagnetic valve means in the carburetors, and a phase difference control unit arranged between the control unit and one of the carburetors for producing a phase difference between the control signals (pulses) supplied to the two electromagnetic valve means, resulting in a smaller fluctuation of the engine A/F.

In the detailed description of the preferred embodiment of the invention presented below, reference is made to the accompanying drawings, in which.

Figure 1:
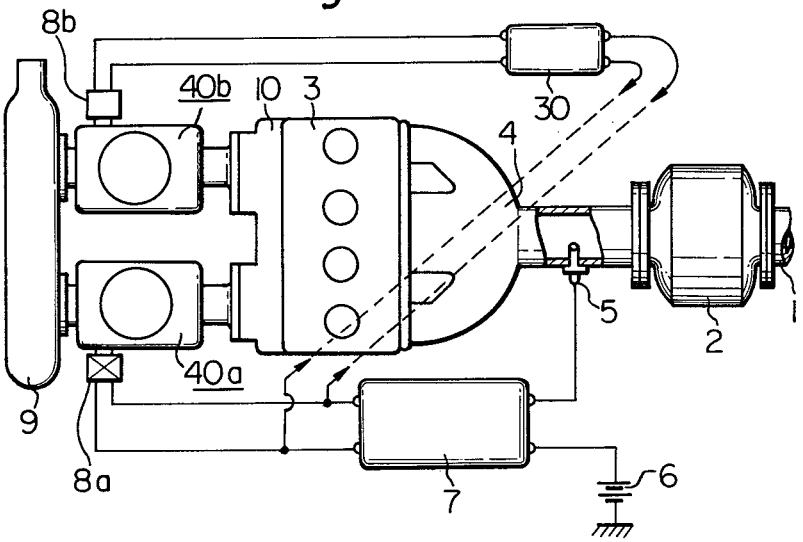
FIG. 1 is a schematic plan view of the engine A/F control system according to the present invention.
Figure 2:
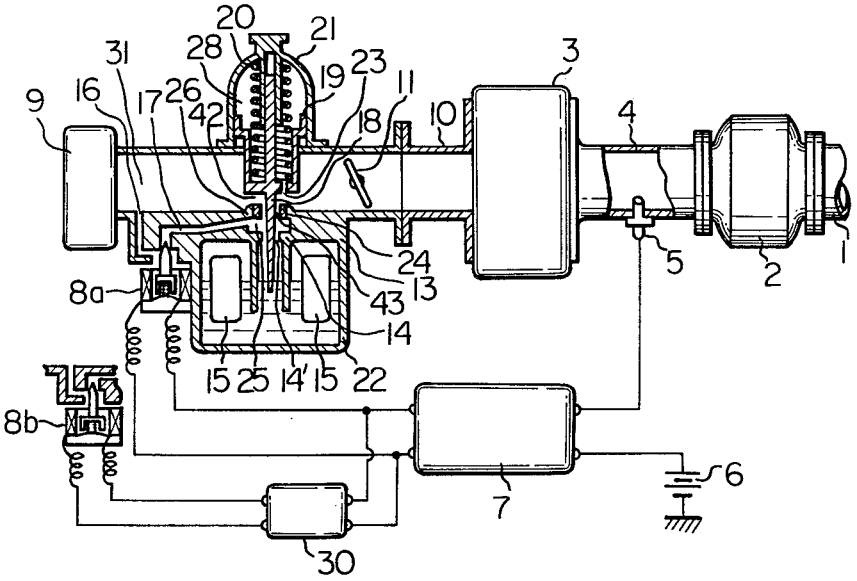
FIG. 2 is a partial sectional side view of FIG. 1 with electromagnetic valve means which are schematically shown.

In FIGS. 1 and 2, 1 shows an exhaust pipe, 2 a catalytic converter, 3 an engine body, 4 an exhaust manifold, 9 an air cleaner, 10 an intake manifold, and 11 a throttle valve. As these elements are per se known, no explanations for the same are being provided.

The SU carburetor with a variable venturi is constructed as follows.

In FIG. 2, a venturi portion 42 is formed below a suction piston 19 which slides inside a vacuum chamber 28 of a housing 21 against a spring 20. The suction piston 19 is provided with a vacuum port 23 through which a venturi vacuum can be given to the vacuum chamber 28. The lift characteristic of the suction piston 19 is therefore mainly determined by the quantity of the suction air from the air cleaner 9, the characteristics of the spring 20 and the piston 19.

The suction piston 19 is provided with a jet needle 18 integrally formed therewith which extends into a float chamber 22 containing fuel. Numeral 15 shows floats in the float chamber 22. A needle seat 14 formed on a carburetor body 13 forms a main jet 14'. To a bridge portion 26 which slightly projects into the venturi portion 42 and forms a main nozzle (orifice) 43 is detachably mounted a ring 24 which is exchangeable to vary the outlet orifice diameter of the main nozzle.

In accordance with the present invention, there is provided in the carburetor body 13 an air-bleed passage 17 opening into the nozzle portion positioned above the main jet 14'. The other end 16 of the air-bleed passage 17 opens into the carburetor bore 31 positioned upstream from the main nozzle 43.

Between the main jet 14' and the ring 24 is formed an air-bleed chamber 25 in which the fuel fed through the main jet 14' from the float chamber 22 is effectively air-bled to regulate the air-fuel ratio of the mixture.

The jet needle 18 has a free end tapered off at the end so that the quantity of fuel flowable through a space between the inner periphery of the needle seat 14 and the outer periphery of the jet needle 18, and accordingly through the inner periphery of the ring 24 and the outer periphery of the jet needle 18 depends on the position of the jet needle 18 integrally formed with the suction piston 19 which moves up and down. An electromagnetic valve means 8*a*(8*b*) is provided in the air-bleed passage 17 for controlling the quantity of the bled air therethrough. The electromagnetic valve means 8*a*(8*b*) is connected through a control unit 7, to an oxygen sensor 5, called a λ sensor, which is per se known and is installed in the exhaust manifold 4. The $0_2$ sensor 5 detects the concentration of oxygen in the exhaust gas and supplies a signal to the control unit 7. Numeral 6 shows an electrical source such as a battery. Consequently, the control unit 7 feeds a pulse to the electromagnetic valve means 8*a*, 8*b*, thereby to open and close said valve means so as to regulate the quantity of the bled air.

When the quantity of the air passing through the venturi 42 formed between the suction piston 19 and the bridge portion 26 with the ring 24, is increased, the speed of the air current is the venturi is correspondingly increased, resulting in an increase of the negative pressure in the vacuum chamber 28. Consequently, the suction piston 19 is raised against the spring 20 so that the cross-sectional area of the venturi is increased to maintain the speed of the air current in the venturi at a constant rate.

As the suction piston 19 is raised, a larger quantity of fuel can be injected from the main nozzle 43 formed by the ring 24 detachably mounted to the bridge portion 26. This is because the space between the outer periphery of the jet needle 18 and the inner periphery of the ring 24 becomes larger since the jet needle 18 has a tapered free end, as mentioned before.

It will be understood that when the suction air passing through the venturi 42 is decreased, an operation contrary to that of the above discussion is effected. Thus, the speed of the air current in the venturi is maintained at a constant rate to some extent, thereby maintaining the engine A/F at a value close to a predetermined value.

There is additionally provided an air-bleed passage 17 opening into the main nozzle as mentioned before, wherein the quantity of the bled air is regulated by the electromagnetic valve means 8*a*(8*b*). That is to say, the $O_2$ sensor 5 installed in the exhaust manifold 4 detects the concentration of the oxygen in the exhaust gas and supplies a corresponding signal to the control unit 7 in which the measurement of the $O_2$ concentration is compared with a predetermined standard. On the other hand, the electromagnetic valve means 8*a*(8*b*) is operated so as to repeatedly open and close with a constant frequency. When there is a difference between said standard and said measurement, the width of the pulse, which pulse is supplied from the control unit 7 to the valve means 8*a*(8*b*) and which occurs during a period in which the valve means 8*a*(8*b*) continues to be opened, changes in response to the difference, resulting in an increased or decreased opening duration of the valve means 8*a*(8*b*). That is, the time duration in which the valve means 8*a*(8*b*) continues to be opened is increased or decreased for increasing or decreasing the quantity of the bled air. Consequently, the quantity of the air to be bled into the fuel sucked into the main nozzle through the main jet 14 is regulated to control the air-fuel ratio of the mixture. If the concentration of oxygen in the exhaust gas detected by the $O_2$ sensor 5 increases, the air bled from the air-bleed passage 17 is decreased and vice versa.

According to the present invention, twin SU carburetors 40*a* and 40*b* are provided for the four-cylinder engine as shown in FIG. 1, the arrangement of which includes two cylinders provided for each SU carburetor. The arrangement per se is known, but both SU carburetors are quite identically and simultaneously operated in the prior art, resulting in a large fluctuation of the resultant engine A/F, as mentioned before. In accordance with the present invention, there is provided a phase difference, for example, of 180° between the two electromagnetic valve means 8*a* and 8*b* of the carburetors 40*a* and 40*b* for minimizing the A/F fluctuation, and more precisely, the phase difference is provided between input pulses fed into the electromagnetic valve means 8*a*, 8*b*. The result is that the air-bleeding operation of one of the carburetors is delayed by an interval of time corresponding to the phase difference, with respect to that of the other carburetor. To achieve this end, there is provided a phase difference control unit 30 in one of the carburetors, for example, carburetor 40*b*, as shown in FIGS. 1 and 2. Thus, a signal from a common oxygen sensor 5 which detects the concentration of oxygen in the exhaust gas is supplied to the control unit 7 which supplies the same control pulse directly to the electromagnetic valve means 8*a* and also to the electromagnetic valve means 8*b* by way of the phase difference control unit 30. A phase difference, for example, of 180°, occurs between the control pulses fed to the electromagnetic valve means 8*a* and 8*b*, due to the presence of the phase difference control unit 30.

The relationship between the phases of the control pulses will now be explained by reference to FIGS. 3 and 4.

Figure 3:
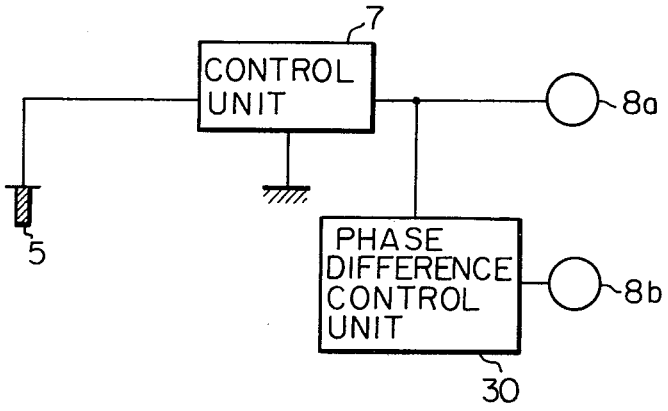
FIG. 3 is an example of a circuit for feed-back controlling the engine A/F.

As is schematically shown in FIG. 3, a signal from the common $O_2$ sensor 5 is fed into the control unit 7 in which the measurement of the $O_2$ concentration i.e., the output voltage of the $O_2$ sensor is compared with a predetermined standard i.e., a reference voltage, and control unit 7 supplies a control pulse directly to the electromagnetic valve means 8*a* and also to the phase difference control unit 30. To the electromagnetic valve means 8*b*, is fed a control pulse with a delay time with respect to the control pulse directly fed to the electromagnetic valve means 8*a*.

Figure 4:
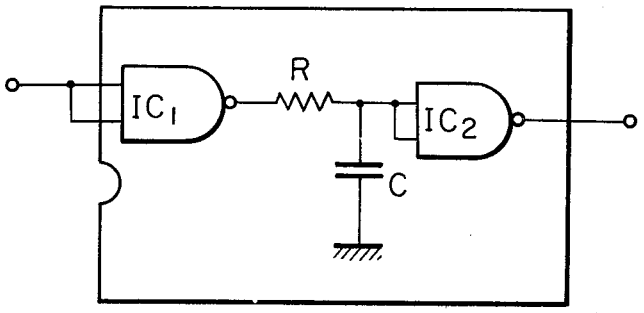
FIG. 4 is an example of a phase difference control circuit.

One embodiment of the phase difference control unit 30 is shown in FIG. 4 in which it comprises a delay circuit having two integrated circuits ($IC_1$, $IC_2$) which are both NAND circuits. For the purpose of a simple explanation, "ON" and "OFF" signals from the control unit 7 fed into the delay circuit are designated by "1", and "0", respectively, hereinafter.

Case (I): when the input signal fed into the delay circuit is "0".

Since input signals fed into the two input terminals of $IC_1$ are both "0", the output signal of $IC_1$ is "1". Consequently, the input signals fed into the two input terminals of $IC_2$ are both "1", and, therefore, the output signal of $IC_2$ is "0". That is, when the input signal of the phase difference control unit 30 is "0", the output signal thereof is "0". In this case (I), the output signal of $IC_1$ is not fed into $IC_2$ until the condenser C is charged to a predetermined high level voltage; that is, the output signal is fed into $IC_2$ with a delay time $\Delta t$ which can be determined by the resistance R and the capacity of the condenser C. Therefore, the delay time $\Delta t$ is set in such a way that $\Delta t$ corresponds to the desired phase difference. The result is that the input signal into the electromagnetic valve means 8*b* is delayed by $\Delta t$ with respect to the input signal fed into the electromagnetic valve means 8*a*.

Case (II); when the input signal fed into the delay circuit is "1"

Since input signals fed into the two input terminals of $IC_1$ are both "1", the output signal thereof is "0". Consequently, the input signals fed into the two input terminals of $IC_2$ are both "0", and, therefore, the output signal of $IC_2$ is "1". Also in this case (II), similarly to the before-mentioned case (I), the output signal of $IC_1$ is not supplied into $IC_2$, until the condenser C is discharged to a predetermined voltage (low level); that is, the output signal is supplied into $IC_2$ with a delay time $\Delta t$ which can be determined by the resistance R and the condenser C.

As is apparent from the above discussion, "ON" and "OFF" signals from the control unit 7 into the electromagnetic valve means 8*b* are delayed by $\Delta t$, i.e., a phase difference corresponding to $\Delta t$ with respect to "ON" and "OFF" signals from the control unit 7 into the electromagnetic valve means 8*a*, respectively.

It can be noted that the pulse shape of the input signal of the electromagnetic valve means 8*a* is quite similar to that of the input signal of the electromagnetic valve means 8*b* since the $O_2$ sensor 5 and the control unit 7 are common to both the carburetors 40*a* and 40*b*, although there is a phase difference existing therebetween.

Figure 5A:
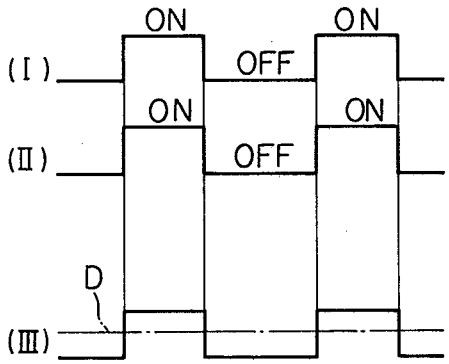
FIGS. 5A and 5B are views showing a relationship between a fluctuation of the engine A/F and an input pulse supplied to the electromagnetic valve means, in case of no phase difference and in case of the existence of a 180° phase difference, between the two valve means, respectively.

Now, assuming that the pulse shapes of the input signals of the electromagnetic valve means 8*a* and 8*b* are, for example, shown in (I) and (II) of FIG. 5A, respectively; then, the resultant fluctuation of the engine A/F which is the sum of the fluctuations of the engine A/F in the two carburetor is shown in (III) of FIG. 5A, wherein a dot-dash line D shows a desired engine A/F, for example, a stoichiometric A/F. The electromagnetic valve means 8*a* and 8*b* are operated so as to repeatedly open and close with a constant frequency. When the engine A/F is below a predetermined desirable engine A/F designated by the dot-dash line D, the $0_2$ sensor 5 detects the concentration of the oxygen in the exhaust gas which is corresponding decreased and then supplies a corresponding signal to the control unit 7 which consequently supplies a control pulse to the electromagnetic valve means 8*a* and 8*b* to increase the "ON" time duration of the pulse, i.e., to increase the duty ratio of the pulse, thereby increasing the amount of bled air.

On the other hand, when the engine A/F is above the desirable engine A/F, as a result of the increased bled air, the $0_2$ sensor 5 detects the correspondingly increased concentration of the oxygen and supplies a corresponding signal to the control unit 7 to increase the "OFF" time duration of the pulse, i.e., to decrease the duty ratio of the pulse, thereby restricting the air-bleed operation. Thus, the electromagnetic valve means 8*a* and 8*b* repeat the "ON" and "OFF" process by which the duty ratio of the ON-OFF pulse is varied in order to maintain the engine A/F at a value very close to the desirable engine A/F, for example, the stoichiometric engine A/F. It can be noted that an increased frequency of the control pulse emanating from the control unit 7 is preferable.

Figure 5B:
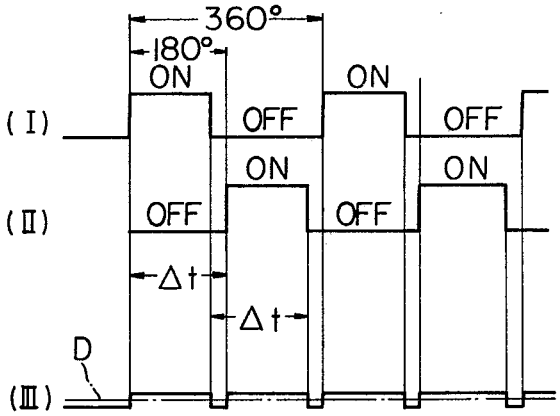

According to the present invention, since there occurs a time delay corresponding to $\Delta t$ in the input pulse (shown in (I) of FIG. 5B) supplied to the electromagnetic valve means 8*b*, with respect to the input pulse (shown in (II) of FIG. 5B) supplied to the electromagnetic valve means 8*a*, the fluctuation of the engine A/F becomes small.

In FIG. 5B, the pulse (II) is delayed by $\Delta t$ with respect to the pulse (I). That is, the pulse (II) becomes "ON" and "OFF" with a time delay of $\Delta t$ with respect to "ON" and "OFF" of the pulse (I), as can be seen from FIG. 5B. The pulse shape per se depends on the $0_2$ sensor. As for the pulse shape shown in FIG. 5B, in which the "ON" time duration (i.e., pulse width) is shorter than the "OFF" time duration, it can be noted that the frequency of the pulse showing a fluctuation of the engine A/F (FIG. 5B(III) becomes substantially twice that shown in FIG. 5A(III). In addition, since when one of the electromagnetic valve means 8*a* and 8*b* is in the "ON" state, and the other is always in the "OFF" state, the entire fluctuation of the engine A/F is not a resultant of the fluctuation of the engine A/F in both carburetors, unlike that of the prior art shown in FIG. 5A(III), but said entire fluctuation is a fluctuation of the engine A/F in either one of the twin carburetors. This means that the fluctuation of the engine A/F decreases.

As mentioned before, the delay time $\Delta t$ is determined by the phase difference control unit 30 in such a way that it corresponds to a desired phase difference which in turn depends on the shape of the voltage pulse emanating from the control unit 7.

As is apparent from the above discussion, according to the present invention, the air-bleed operation in one of the twin SU carburetors is delayed by $\Delta t$ with respect to the air-bleed operation in the other carburetor so that the fluctuation of the engine A/F decreases.

The present invention can be advantageously used in an internal combustion engine with a three-way catalytic converter which requires for its optimum operation a constant concentration of oxygen in the exhaust gas to be fed into the catalytic converter, that is, which requires a constant A/F of the mixture.

What is claimed is:

1. In combination with an internal combustion engine having an air fuel ratio feedback control system comprising; at least two carburetors each including a main nozzle, a venturi through which the suction air from an air cleaner passes, an air bleed passage, and an electromagnetic valve means arranged in said air bleed passage for regulating the quantity of the bled air; a common oxygen sensor installed in an exhaust manifold of said engine for detecting the concentration of oxygen in the exhaust gas; and a control unit which is connected to said oxygen sensor and in which the measurement by said oxygen sensor is compared with a predetermined standard, each said electromagnetic valve means being connected to said oxygen sensor through said control unit and being operated to repeatedly open and close with a frequency produced by an output pulse from said control unit, wherein the pulse width of said output pulse during which said valve means continues to be opened is changed, where there is a difference between said measurement and said standard by said control unit in response to said difference; wherein the improvement comprises a phase difference control unit interposed between said control unit and at least one of said electromagnetic valve means for producing a phase difference between said output pulses supplied to said at least two electromagnetic valve means from said control unit.

2. An air-fuel ratio control system as set forth in claim 1, wherein said phase difference control unit comprises two integrated circuits which are both NAND circuits, and a delay circuit comprised of a resistor and a condenser, the input of one of the integrated circuits being connected to the output of said control unit, the output thereof being connected to the input of the other integrated circuit through said delay circuit, the output of the latter integrated circuit being connected to one of the electromagnetic valve means.

3. In combination with an internal combustion engine having an air fuel ratio feedback control system comprising; at least two carburetors each including a main nozzle, a venturi through which the suction air from an air cleaner passes, an air bleed passage, and an electromagnetic valve means arranged in said air bleed passage for regulating the quantity of the bled air; a three-way catalytic converter for cleaning up the exhaust gas; a common oxygen sensor installed in an exhaust manifold of said engine and at the upstream end of said three-way catalytic converter for detecting the concentration of oxygen in the exhaust gas; and a control unit which is connected to said oxygen sensor and in which the measurement by said oxygen sensor is compared with a predetermined standard; each said electromagnetic valve means being connected to said oxygen sensor through said control unit and being operated to repeatedly open and close with a frequency produced by an output pulse from said control unit, wherein the pulse width of said output pulse during which said valve means continues to be opened is changed, when there is a difference between said measurement and said standard by said control unit in response to said difference; wherein the improvement comprises a phase difference control unit interposed between said control unit and one of said electromagnetic valve means for producing a phase difference between said output pulses supplied to said two electromagnetic valve means from said control unit.

4. An air-fuel ratio control system as set forth in claim 1, wherein each said carburetor is an SU carburetor comprising; a variable venturi in which the cross-sectional area of said venturi is varied in response to the flow rate of the suction air from an air cleaner to vary a quantity of the fuel sucked from a main nozzle of said carburetor; an air bleed passage provided in the upstream end of said main nozzle in the carburetor and opening into said nozzle; and an electromagnetic valve means arranged in said air bleed passage for regulating the quantity of the bleed air.

* * * * *